US007770320B1

(12) United States Patent
Bartak

(10) Patent No.: US 7,770,320 B1
(45) Date of Patent: Aug. 10, 2010

(54) BIPOD RIFLE SUPPORT

(76) Inventor: Tom Bartak, P.O. Box 124, Center, NE (US) 68724

( * ) Notice: Subject to any disclaimer, the term of this patent is extended or adjusted under 35 U.S.C. 154(b) by 336 days.

(21) Appl. No.: 12/082,362

(22) Filed: Apr. 10, 2008

(51) Int. Cl.
*F41A 23/08* (2006.01)

(52) U.S. Cl. ..... 42/94; 42/72; 89/37.04

(58) Field of Classification Search ..... 42/94, 42/71.01, 72, 73; 89/37.03, 37.04; 248/685; 124/29
See application file for complete search history.

(56) References Cited

U.S. PATENT DOCUMENTS 4,776,124 A 10/1988 Clifton
5,029,407 A * 7/1991 Kirkpatrick ..... 42/94
5,194,678 A * 3/1993 Kramer ..... 42/94
5,852,892 A * 12/1998 Bilgeri et al. ..... 42/94
5,930,932 A * 8/1999 Peterson ..... 42/94
5,930,933 A * 8/1999 Schleicher ..... 42/94
6,289,622 B1 * 9/2001 Desch et al. ..... 42/94
7,676,979 B1 * 3/2010 Mertz ..... 42/94
2007/0094911 A1 5/2007 Rush et al.
2007/0261287 A1 * 11/2007 Hunt et al. ..... 42/94
2008/0307689 A1 * 12/2008 Dotson ..... 42/94

* cited by examiner

*Primary Examiner*—Benjamin P Lee
(74) *Attorney, Agent, or Firm*—Dennis L. Thomte; Thomte Patent Law Office LLC

(57) ABSTRACT

A bipod rifle support which may be incorporated into the stock of the rifle itself or which may be incorporated into a body member which is attachable to the forward end of the rifle stock. Support legs are normally stowed within the elongated bores with the same being removable therefrom and inserted into sockets or bores so that the support legs extend downwardly and outwardly from the stock for engagement with a supporting surface such as the ground or the like. The support legs have elastic cords secured thereto which maintain the support legs in their stowed position and in their rifle support position.

16 Claims, 8 Drawing Sheets

BIPOD RIFLE SUPPORT

BACKGROUND OF THE INVENTION

1. Field of the Invention

This invention relates to a bipod rifle support and more particularly to a bipod rifle support which may be either attached to a rifle stock or wherein the rifle stock may be modified to accept the bipod support.

2. Description of the Related Art

Bipod rifle supports have long been used to support the forward end or muzzle of a rifle during the firing thereof in an effort to "steady" or "stabilize" the rifle to increase the shooter's accuracy. The bipod rifle supports are also useful to support the muzzle of the rifle above the ground or other supporting surface during periods when the rifle is not being fired or is being cleaned.

Many types of bipod rifle supports have been previously provided but it is believed they suffer from certain disadvantages. Certain of the prior art bipod rifle supports are large, cumbersome, difficult to use and detract from the appearance of the rifle.

SUMMARY OF THE INVENTION

The bipod rifle support of this invention is illustrated herein in two different forms. In one embodiment, the bipod rifle support is contained within an elongated body member which is attached to the underside of the fore-end of the rifle stock. In the second embodiment, the rifle stock is modified so as to accept the bipod rifle support of this invention.

In the embodiment wherein the bipod rifle support is secured to the underside of the fore-end of the rifle stock, the support includes an elongated body member having a forward end, a rearward end, a first side, a second side, an upper surface and a lower surface. The body member is selectively removably attachable to the stock at the fore-end thereof. First and second horizontally spaced-apart elongated bores are formed in the body member which have forward ends exiting from the forward end of the body member and which have rearward ends positioned adjacent the rearward end of the body member. A third bore, having upper and lower ends, is formed in the body member adjacent the forward end thereof adjacent one side thereof which extends upwardly into the body member from the lower surface thereof with the upper end of the third bore communicating with the first bore, rearwardly of the forward end thereof. A fourth bore, having upper and lower ends, is formed in the body member adjacent the forward end thereof adjacent the other side thereof which extends upwardly into the body member from the lower surface thereof with the upper end of the fourth bore communicating with the second bore rearwardly of the forward end thereof. A first slot is formed in the body member which extends forwardly from the third bore for the entire length thereof to the forward end of the first bore. A second slot is formed in the body member which extends forwardly from the fourth bore for the entire length thereof to the forward end of the second bore.

First and second elongated elastic cords are also included which have forward and rearward ends. The rearward end of the first elastic cord is secured to the body member adjacent the rearward end thereof with the first elastic cord extending forwardly from its rearward end through the first bore. The rearward end of the second elastic cord is secured to the body member adjacent the rearward end thereof and extends forwardly therefrom through the second bore. First and second elongated support legs having first and second ends are also provided. The first and second support legs are sized so as to be selectively received by the first and second bores respectively. The forward ends of the first and second elastic cords are secured to the first and second support legs respectively.

The first and second support legs are selectively movable between a stowed position within the first and second bores respectively to a rifle support position wherein the first ends of the first and second support legs are positioned in the third and fourth bores respectively. The first and second slots permit the first and second elastic cords to pass therethrough as the support legs are moved from their stowed position to their rifle support positions and vice versa. The connection of the elastic cords to the support legs causes the support legs to be yieldably maintained in their stowed and rifle support positions.

In the preferred embodiment, the third and fourth bores extend upwardly, laterally and forwardly into the body member from the lower surface thereof. In the second embodiment of the invention, the body member is not utilized with the rifle stock having the first, second, third and fourth bores formed therein and having the first and second slots formed therein.

It is therefore a principal object of the invention to provide an improved bipod rifle support.

Still another object of the invention is to provide an improved bipod rifle support which may be either contained within a body member which is attachable to the underside of the fore-end of the rifle stock or which may be incorporated into the rifle stock itself.

Still another object of the invention is to provide a bipod rifle support which is aesthetic in appearance.

Still another object of the invention is to provide a bipod rifle support which is easily attachable to the underside of the fore-end of a rifle stock.

Still another object of the invention is to provide a bipod rifle support which is positioned in the rifle stock itself which may be removed therefrom to support the rifle stock.

Still another object of the invention is to provide a bipod rifle support which enables the rifle to be supported during the firing thereof or which may be used to support the rifle during periods of non-use.

Still another object of the invention is to provide a bipod rifle support which is economical of manufacture, durable in use and refined in appearance.

These and other objects will be apparent to those skilled in the art.

DESCRIPTION OF THE PREFERRED EMBODIMENT

Figure 1:
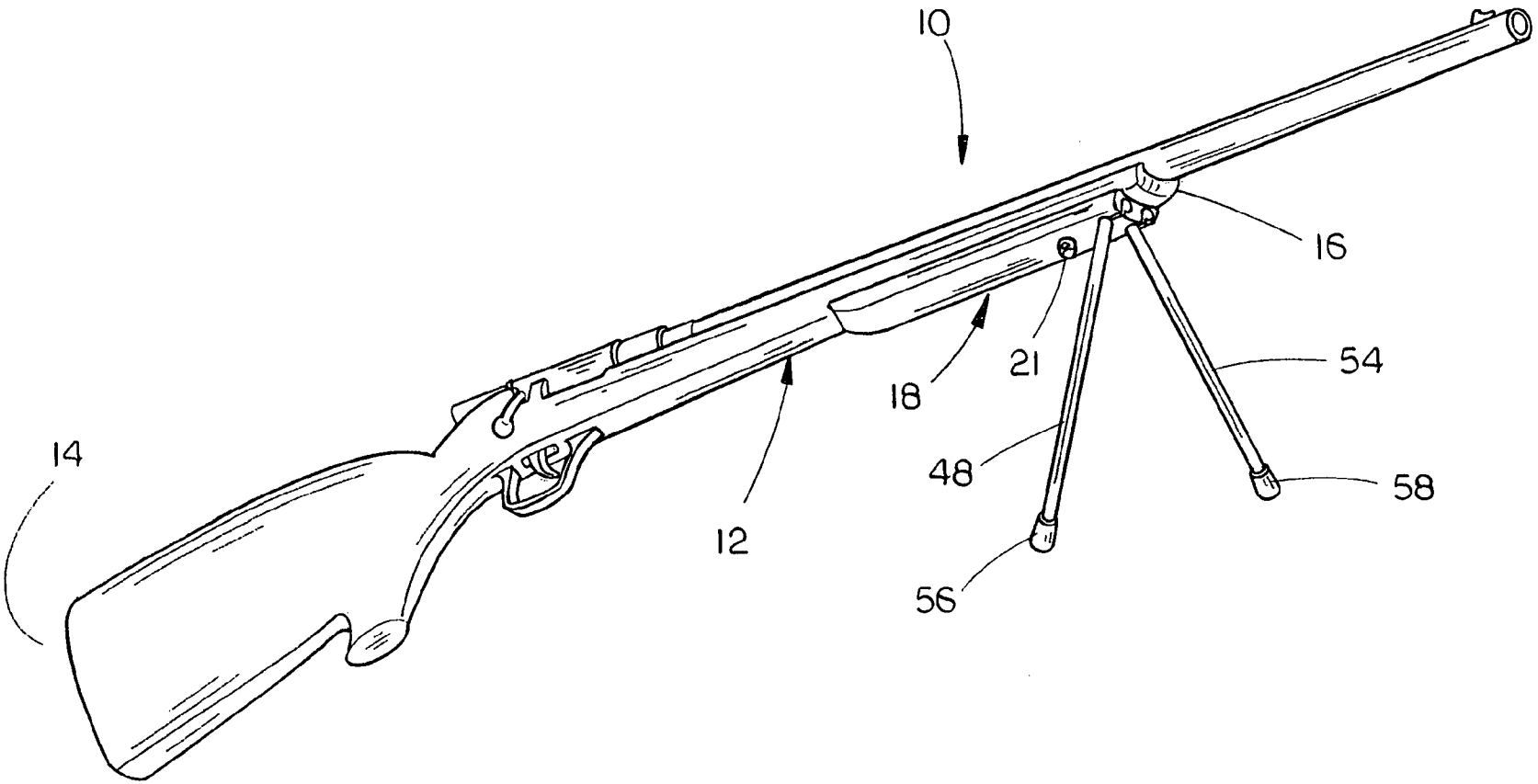
FIG. 1 is a perspective view illustrating the bipod rifle support of this invention with the legs thereof in their extended position.
Figure 2:
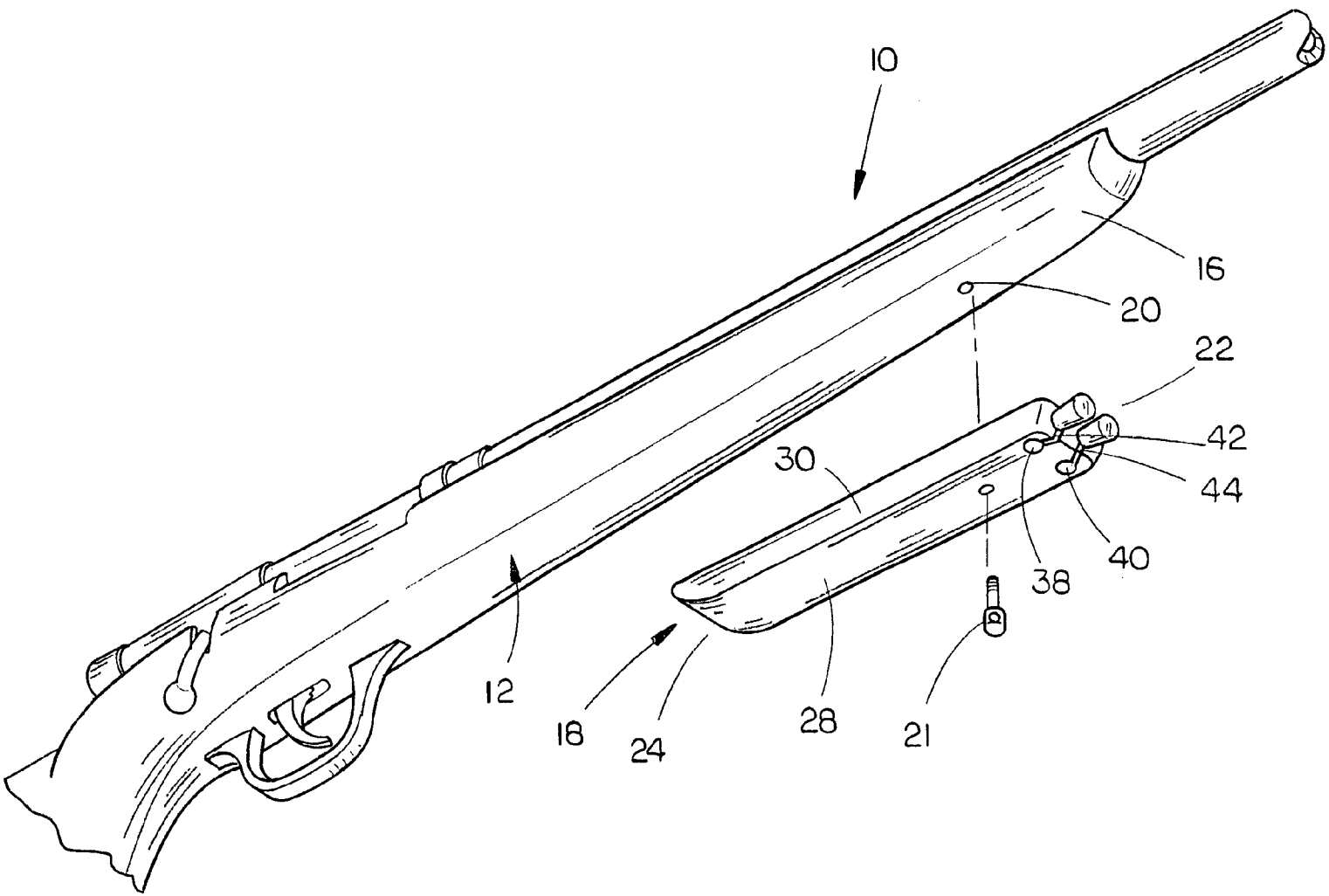
FIG. 2 is a partial perspective view illustrating a manner in which the body member of the first embodiment may be attached to the fore-end of a rifle stock.

In the drawings, the numeral 10 refers to a rifle of conventional design including a stock 12 having a butt portion 14 and a fore-end 16. As stated hereinabove, the bipod rifle support of this invention may be incorporated into the forward end of the rifle stock 12 as seen in FIG. 9, or may be incorporated into an elongated body member 18 which is selectively removably secured to the underside of the fore-end 16 of the stock 12 as seen in FIGS. 1-8. In most cases, the stock 12 will have an internally threaded opening 20 formed in the underside of the stock 12 (FIG. 2) to which is normally attached a sling stud 21. Body member 18 is removably secured to stock 12 by the sling screw 21.

For purposes of description, body member 18 will be described as having a forward end 22, rearward end 24, an upper surface 26 and a lower surface 28. Preferably, the body member 18 will be comprised of the same material as the stock. For example, if the stock 12 is comprised of a wood material, the body member 18 will normally be comprised of a wood material. If the stock 12 is comprised of a composite material, the body member 18 will also be comprised of a composite material. Body member 18 also includes a first side 30 and a second side 32.

Figure 7:
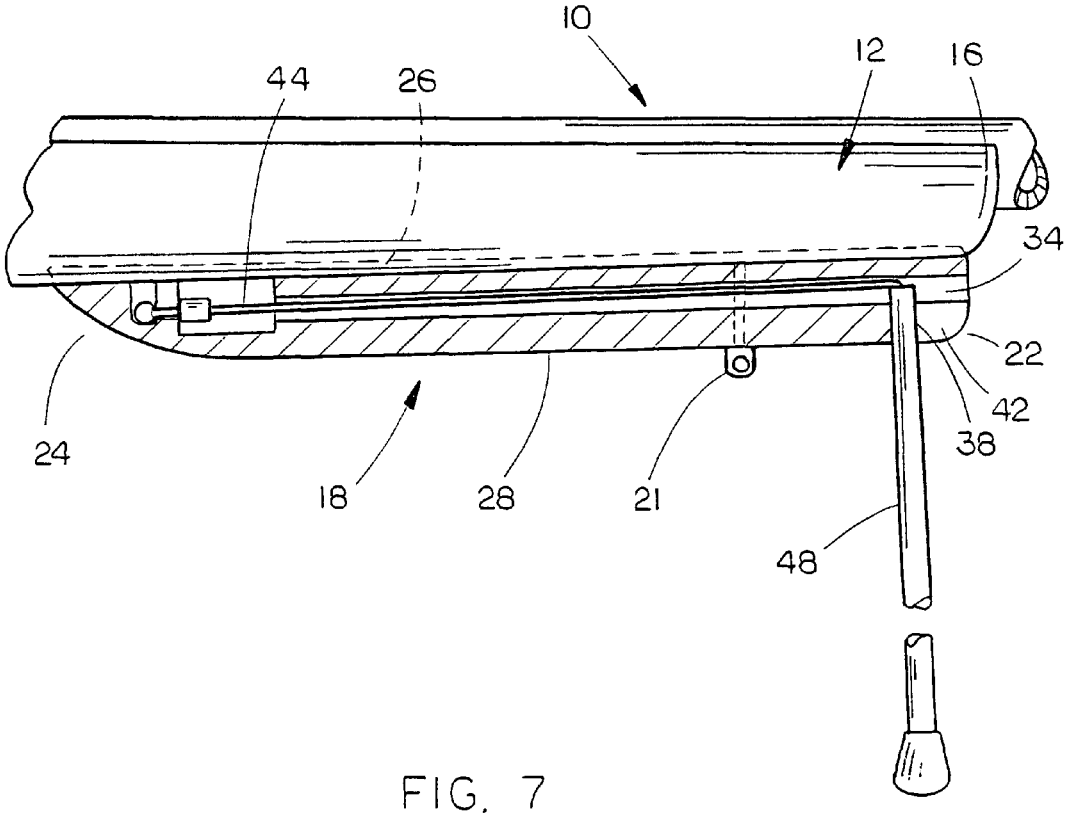
FIG. 7 is a view similar to FIG. 6 except that one of the support legs is in its rifle support position.

The body member 18 has first and second horizontally spaced-apart elongated bores 34 and 36 formed therein (FIG. 3) which have forward ends exiting from the forward end of the body member 18 and which have rearward ends positioned adjacent the rearward end of the body member 18 as seen in FIG. 7.

Body member 18 also has a third bore or socket 38 having upper and lower ends, formed therein adjacent the forward end thereof which extends upwardly into the body member 18 from the lower surface 28 with the upper end of the third bore 38 communicating with the first bore 34 rearwardly of the forward end thereof. Preferably, the third bore 38 extends upwardly, laterally and forwardly into the body member 18 from the lower surface 28 thereof. The body member 18 also has a fourth bore or socket 40, having upper and lower ends, formed therein adjacent the forward end thereof which preferably extends upwardly, laterally and forwardly into the body member 18 from the lower surface 28 thereof. The upper end of bore 40 communicates with the second bore 36 rearwardly of the forward end thereof.

Body member 18 also has a first slot 42 formed therein which extends forwardly from the third bore 38 for the entire length thereof to the forward end of the first bore 34. The body member 18 also has a second slot 44 formed therein which extends forwardly from the fourth bore 40 for the entire length thereof to the forward end of the second bore 36.

Figure 3:
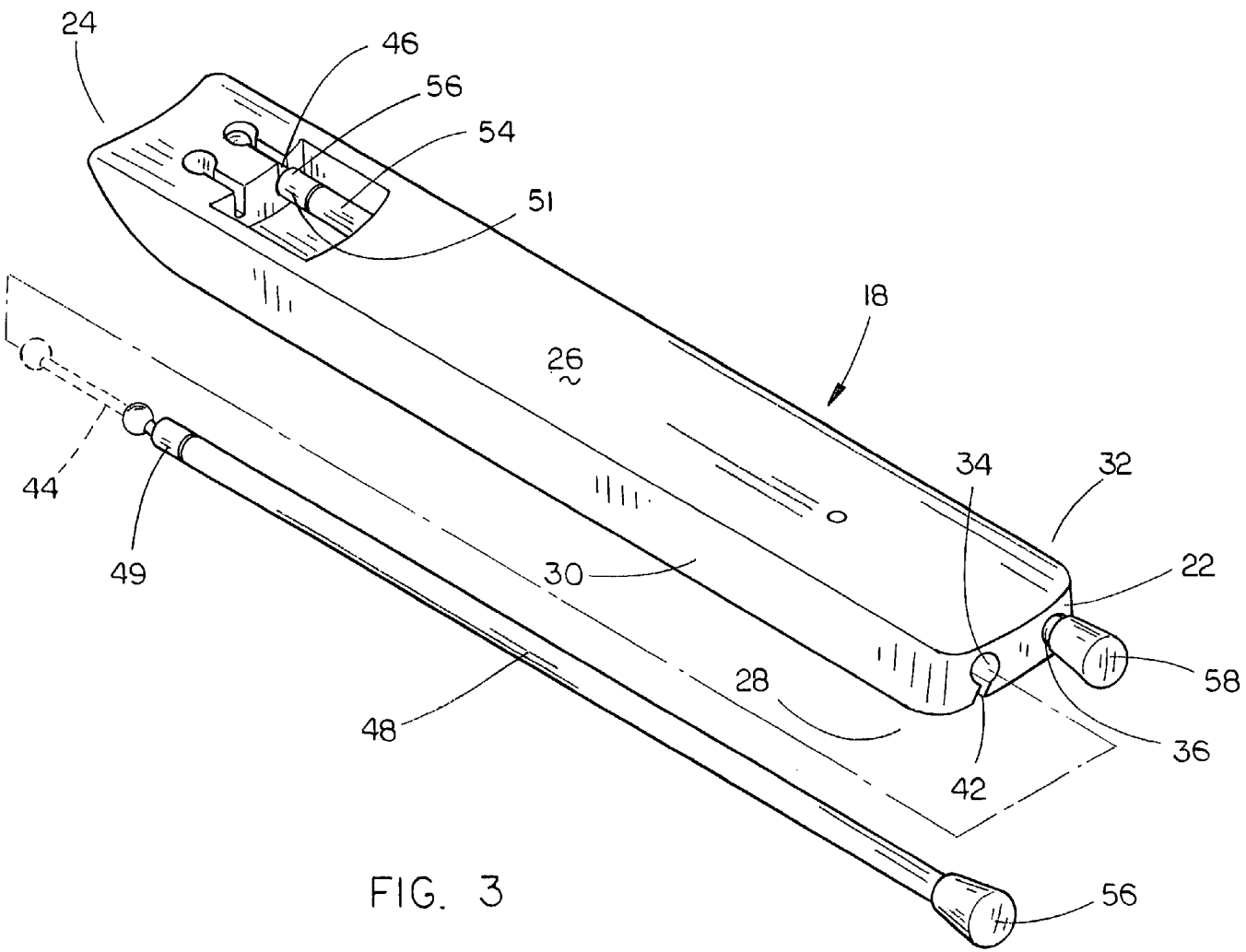
FIG. 3 is an exploded perspective view of the body member of FIG. 2.
Figure 4:
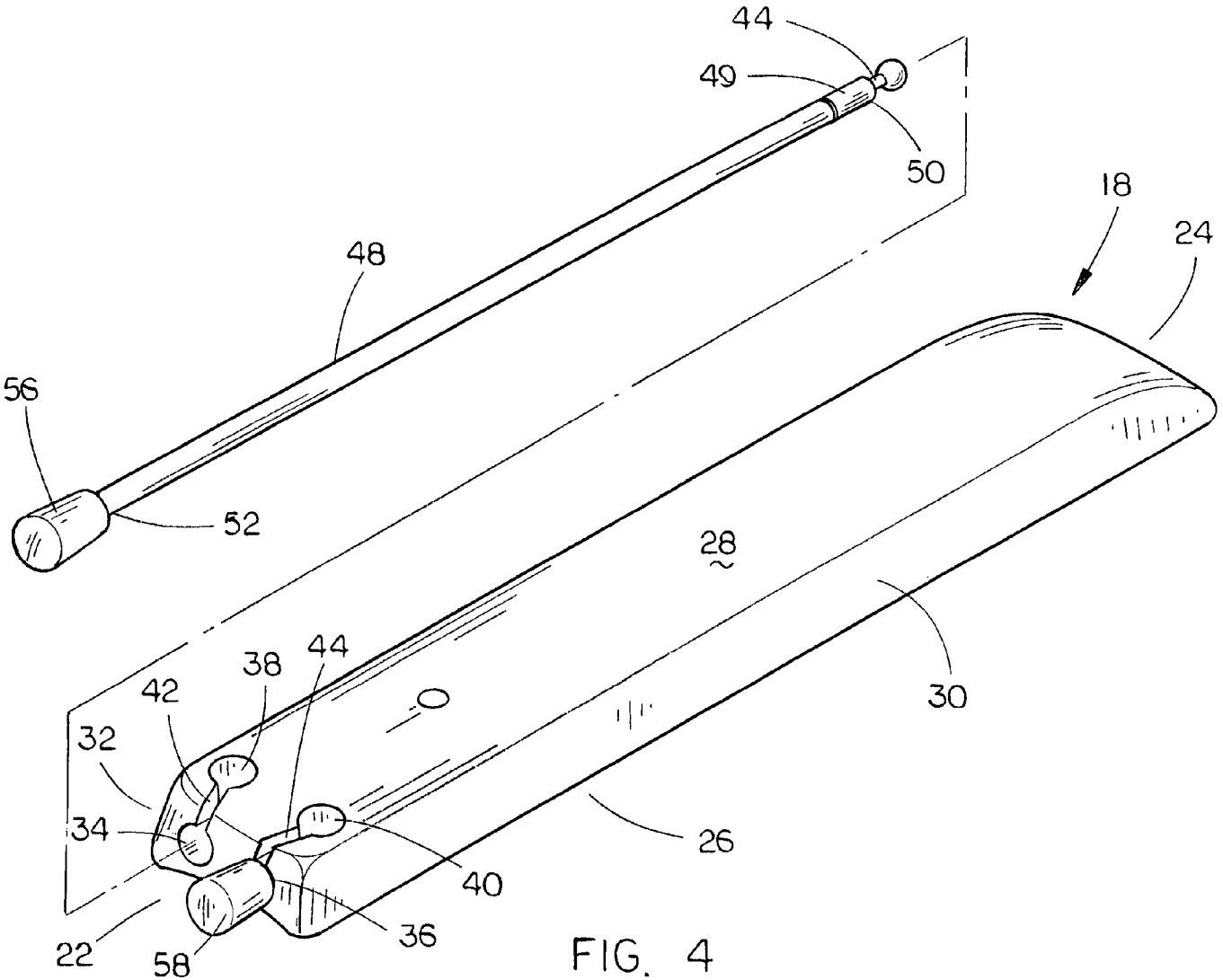
FIG. 4 is an exploded perspective view as viewed from the bottom side of the body member of the embodiment of FIG. 2.
Figure 5:
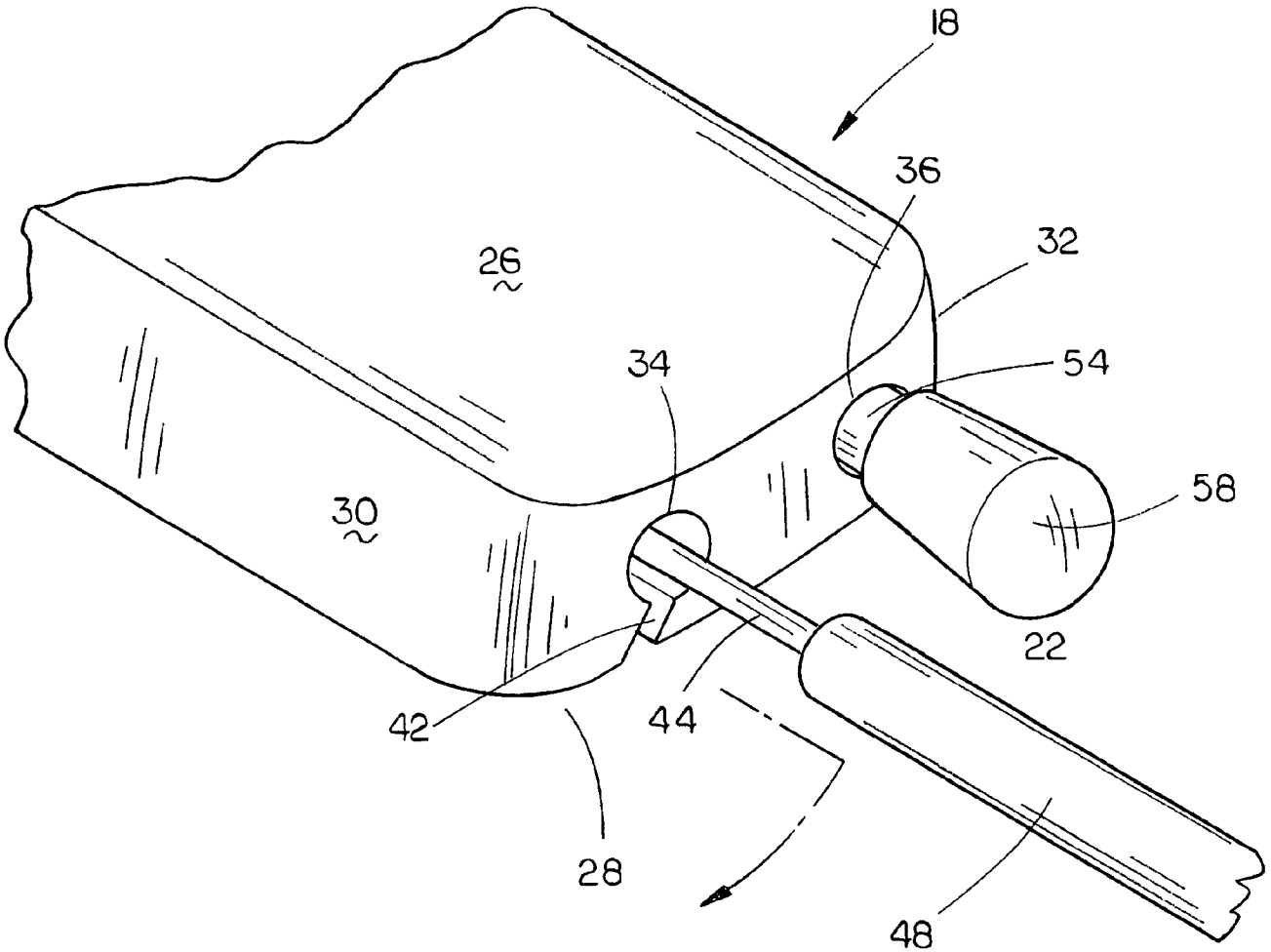
FIG. 5 is a partial front perspective view of the embodiment of FIG. 2.
Figure 6:
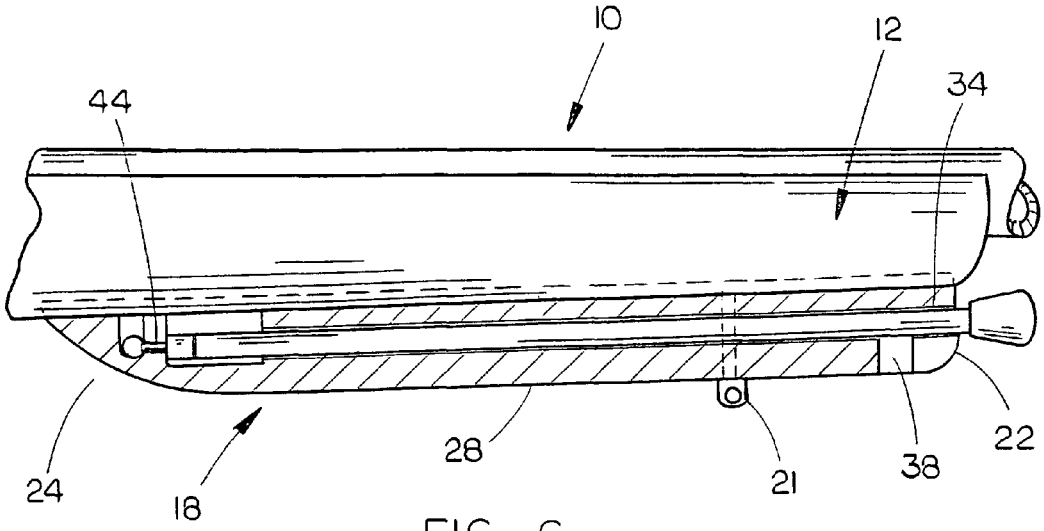
FIG. 6 is partial side sectional view of the embodiment of FIG. 2 illustrating the body member attached to the fore-end of the rifle and with the support legs in their stowed positions.

The numerals 44 and 46 refer to first and second elongated elastic cords which have forward and rearward ends. The rearward end of the first elastic cord 44 is secured to the body member adjacent the rearward end thereof. The first elastic cord 44 extends forwardly from its rearward end through the first bore 34. The rearward end of the second elastic cord 46 is secured to the body member 18 adjacent the rearward end thereof and extends forwardly therefrom through the second bore 36. Rubber shock absorbers 49 and 51 are slidably mounted on the cords 44 and 46 as seen in FIG. 3 to cushion the impact of the legs associated therewith as will be explained in more detail hereinafter.

The numeral 48 refers to a first elongated support leg having a first end 50 and a second end 52. The numeral 54 refers to a second elongated support leg having a first end 56 and a second end 58. The first and second support legs 48 and 54 are sized so as to be selectively received by the first and second bores 34 and 36 respectively.

Figure 8:
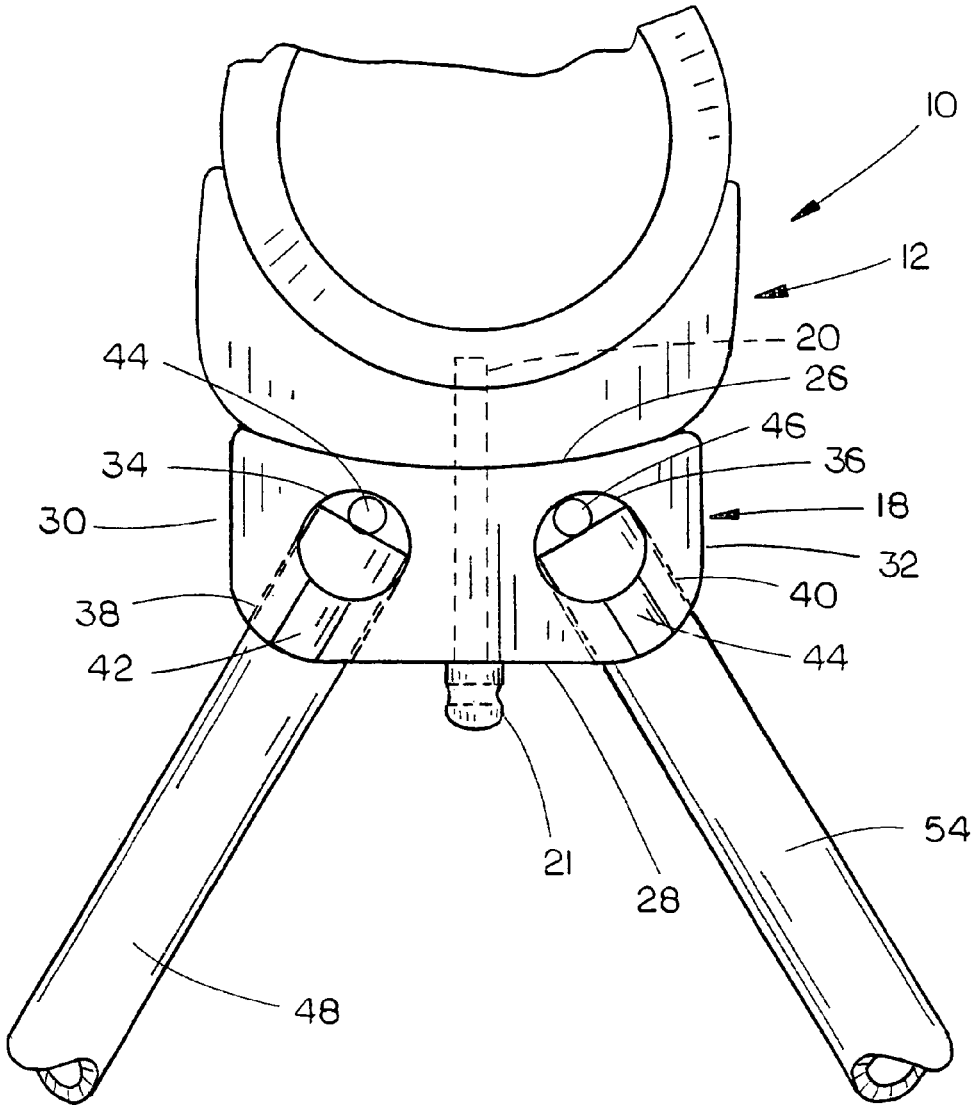
FIG. 8 is a front view of the embodiment of FIG. 2 illustrating the support legs in their rifle support positions.
Figure 9:
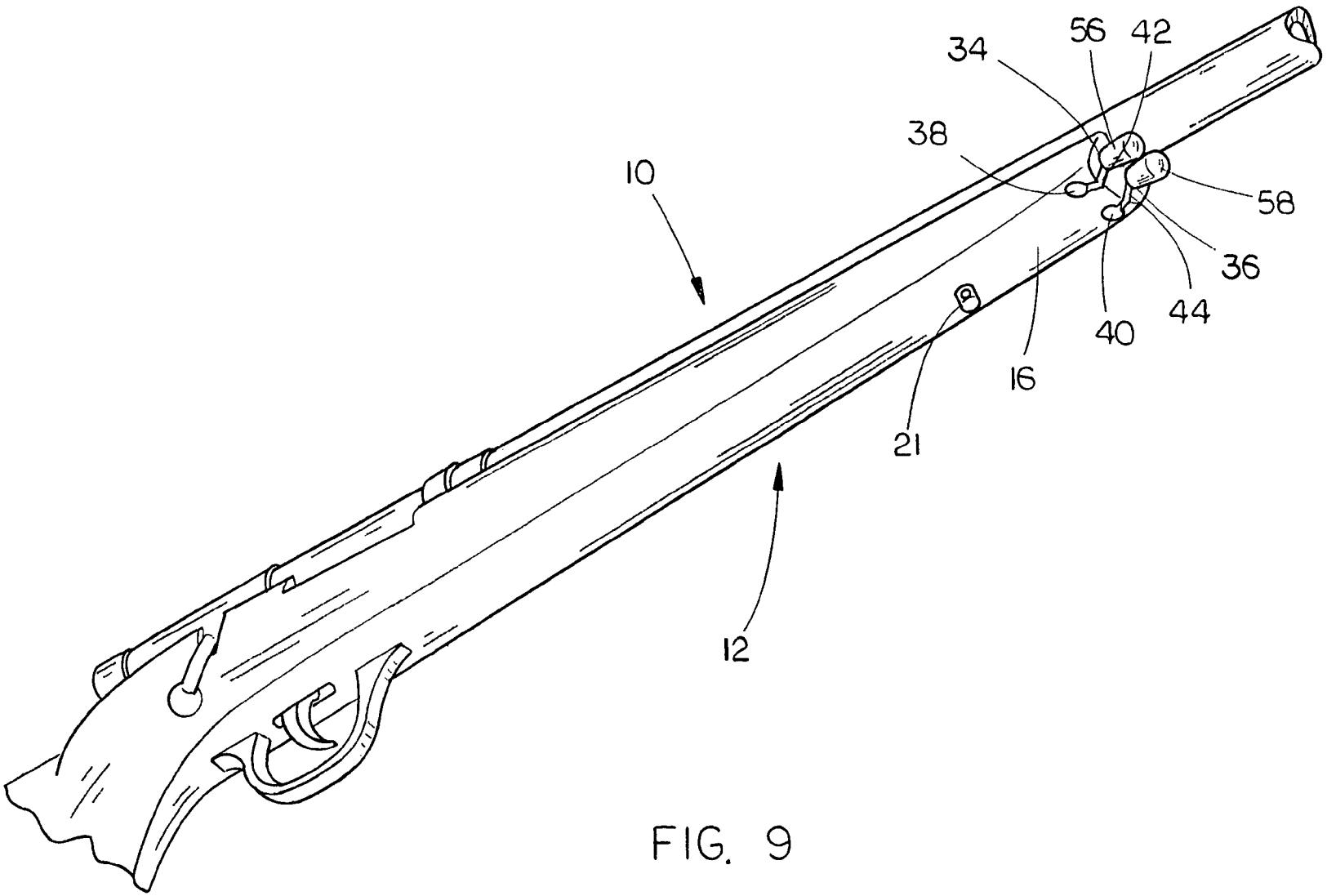
FIG. 9 is a partial perspective view of a rifle stock having the bipod rifle support assembly incorporated in the forward end thereof.

The first and second support legs 48 and 54 are selectively movable between a stowed position within the first and second bores 34 and 36 respectively (FIG. 2) to a rifle support position as seen in FIGS. 1 and 8 wherein the first ends of the support legs 48 and 54 are positioned in the third and fourth bores 38 and 40 respectively. The first and second slots 42 and 44 permit the first and second elastic cords 44 and 46 to pass therethrough as the support legs 48 and 54 are moved from their stowed position to their rifle support positions and vice versa.

In the second embodiment of this invention illustrated in FIG. 9, the body member 18 is eliminated with the bores 34, 36, 38 and 40 and the slots 42 and 44 being formed in the fore-end or the forward end of the rifle stock respectively. The bores and the slots may either be created in the rifle stock at the factory or a suitable gun shop. In either case, the second ends of the support legs 48 and 54 have enlarged resilient foot portions 56 and 58 secured thereto to prevent the support legs 48 and 54 from slipping on the supporting surface or for damaging the supporting surface should the rifle be placed on a table or bench.

It can be seen from the foregoing that a novel bipod rifle support has been provided which may be included in a body member 18 which is attachable to the rifle stock or which may be incorporated into the stock itself. The bipod rifle support of this invention is extremely durable in use and is refined in appearance and does not detract from the aesthetic appearance of the rifle stock which is important to many riflemen.

Although it has been shown that the elastic cords 44 and 46 are utilized, the elastic cords 44 and 46 could be non-elastic as long as a spring is connected thereto to yieldably urge the support legs 48 and 54 rearwardly into the bores 34 and 36 as well as to yieldably urge the support legs 48 and 54 into the bores 38 and 40.

Thus it can be seen that the invention accomplishes at least all of its stated objectives.

The invention claimed is:

1. In combination with a rifle having a stock with a fore-end, comprising:

an elongated body member having a forward end, a rearward end, a first side, a second side, an upper surface, and a lower surface;

said body member being selectively removably attachable to the stock at the fore-end thereof;

first and second horizontally spaced-apart elongated bores formed in said body member which have forward ends exiting from said forward end of said body member and which have rearward ends positioned adjacent said rearward end of said body member;

a third bore, having upper and lower ends, formed in said body member adjacent said forward end thereof which extends upwardly into said body member from said lower surface thereof with said upper end of said third bore communicating with said first bore rearwardly of said forward end thereof;

a fourth bore, having upper and lower ends, formed in said body member adjacent said forward end thereof which extends upwardly into said body member from said lower surface thereof with said upper end of said fourth bore communicating with said second bore rearwardly of said forward end thereof;

a first slot formed in said body member which extends forwardly from said third bore for the entire length thereof to said forward end of said first bore;

a second slot formed in said body member which extends forwardly from said fourth bore for the entire length thereof to said forward end of said second bore;

a first elongated elastic cord having a forward end and a rearward end;

said rearward end of said first elastic cord being secured to said body member adjacent said rearward end thereof;

said first elastic cord extending forwardly from its said rearward end through said first bore;

a second elongated elastic cord having a forward end and a rearward end;

said rearward end of said second elastic cord being secured to said body member adjacent said rearward end thereof;

said second elastic cord extending forwardly from its said rearward end through said second bore;

first and second elongated support legs having first and second ends;

said first and second support legs being sized so as to be selectively received by said first and second bores respectively;

said forward ends of said first and second elastic cords being secured to said first and second support legs respectively;

said first and second support legs being selectively movable between a stowed position within said first and second bores respectively to a rifle support position wherein said first ends of said first and second support legs are positioned in said third and fourth bores respectively;

said first and second slots permitting said first and second elastic cords to pass therethrough as said support legs are moved from their stowed position to their rifle support positions and vice versa;

the connection of said elastic cords to said support legs causing said support legs to be yieldably maintained in their said stowed and rifle support positions.

2. The combination of claim 1 wherein said third and fourth bores extend upwardly and laterally into said body member from said lower surface thereof.

3. The combination of claim 1 wherein said third and fourth bores extend upwardly, laterally and forwardly into said body member from said lower surface thereof.

4. The combination of claim 1 wherein said lower ends of said third and fourth bores are spaced inwardly of said first and second sides of said body member respectively.

5. The combination of claim 1 wherein the width of each of said first and second slots is less than the diameters of said bores and is greater than the diameter of said elastic cords.

6. The combination of claim 1 wherein said second ends of said support legs are positioned forwardly of said forward end of said body member when in their said stowed positions.

7. The combination of claim 6 wherein said second ends of said support legs have resilient foot portions thereon.

8. The combination of claim 7 wherein said foot portions have a diameter greater than the diameter of said support legs and said first and second bores.

9. In combination:

a rifle having a stock with a fore-end;

said stock having rearward and forward ends and first and second sides;

said stock having a lower surface at said fore-end;

first and second horizontally spaced-apart elongated bores formed in said fore-end which have forward ends exiting from said fore-end and which have rearward ends positioned rearwardly of said fore-end;

a third bore having upper and lower ends, formed in the stock adjacent said forward end which extends upwardly into said stock from the lower surface thereof with said upper end of said third bore communicating with said first bore rearwardly of said forward end thereof;

a fourth bore, having upper and lower ends, formed in said stock adjacent said forward end which extends upwardly into said stock from the lower surface thereof with said upper end of said fourth bore communicating with said second bore rearwardly of said forward end thereof;

a first slot formed in said stock which extends forwardly from said third bore for the entire length thereof to said forward end of said first bore;

a second slot formed in said stock which extends forwardly from said fourth bore for the entire length thereof to said forward end of said second bore;

a first elongated elastic cord having a forward end and a rearward end;

said rearward end of said first elastic cord being secured to said stock rearwardly of said forward end thereof;

said first elastic cord extending forwardly from its said rearward end through said first bore;

a second elongated elastic cord having a forward end and a rearward end;

said rearward end of said second elastic cord being secured to said stock rearwardly of said forward end thereof;

said second elastic cord extending forwardly from its said rearward end through said second bore;

first and second elongated support legs having first and second ends;

said first and second support legs being sized so as to be selectively received by said first and second bores respectively;

said forward ends of said first and second elastic cords being secured to said first and second support legs respectively;

said first and second support legs being selectively movable between a stowed position within said first and second bores respectively to a rifle support position wherein said first ends of said first and second support legs are positioned in said third and fourth bores respectively;

said first and second slots permitting said first and second elastic cords to pass therethrough as said support legs are moved from their stowed position to their rifle support positions and vice versa;

the connection of said elastic cords to said support legs causing said support legs to be yieldably maintained in their said stowed and rifle support positions.

10. The combination of claim 9 wherein said third and fourth bores extend upwardly and laterally into said stock from said lower surface thereof.

11. The combination of claim 9 wherein said third and fourth bores extend upwardly, laterally and forwardly into said stock from said lower surface thereof.

12. The combination of claim 9 wherein said lower ends of said third and fourth bores are spaced inwardly of said first and second sides of said stock respectively.

13. The combination of claim 9 wherein the width of each of said first and second slots is less than the diameters of said bores and is greater than the diameter of said elastic cords.

14. the combination of claim 9 wherein said second ends of said support legs are positioned forwardly of said forward end of said stock when in their said stowed positions.

15. The combination of claim 14 wherein said second ends of said support legs have resilient foot portions thereon.

16. The combination of claim 15 wherein said foot portions have a diameter greater than the diameter of said support legs and said first and second bores.

* * * * *